United States Patent [19]

Starke

[11] 4,386,515

[45] Jun. 7, 1983

[54] SETTING TOOL FOR BLIND FASTENERS

[75] Inventor: David E. Starke, Reading, Pa.

[73] Assignee: USM Corporation, Farmington, Conn.

[21] Appl. No.: 335,866

[22] Filed: Dec. 30, 1981

[51] Int. Cl.[3] ..... B21J 15/34

[52] U.S. Cl. ..... 72/391; 72/453.17

[58] Field of Search ..... 72/391, 114, 453.17

[56] References Cited

U.S. PATENT DOCUMENTS

| | | | |
|---|---|---|---|
| 2,205,772 | 6/1940 | Bowersox | 72/391 |
| 3,348,292 | 10/1967 | Turner | 72/399 |
| 3,837,208 | 9/1974 | Davis | 72/391 |
| 3,934,325 | 1/1976 | Jaffe | 72/391 |

FOREIGN PATENT DOCUMENTS 451396 8/1936 United Kingdom .

*Primary Examiner*—Gene Crosby

*Attorney, Agent, or Firm*—William F. White

[57] ABSTRACT

A tool for installing and setting blind fasteners is disclosed. The tool includes a collet and mandrel arrangement for engaging and setting blind fasteners. The collet is biased in a manner which produces an engagement with the end of the blind fastener insert when the mandrel moves rearward.

10 Claims, 7 Drawing Figures

10
12
14
16
18
20
22
24
26
28
30
32
34
36
38
40
42
44
46
48
50
52
54
56
57
58
60
62
64
10°

SETTING TOOL FOR BLIND FASTENERS

FIELD OF THE INVENTION

This invention relates to tools for setting blind fastener inserts into walls or panels. In particular this invention relates to the setting of a blind fastener insert in a high volume production environment.

BACKGROUND OF THE INVENTION

Production situations in which blind fastener inserts are used to assemble high volume production components is encountered in many different industries. For example, in the automobile industry, many situations arise wherein a component must be attached to a panel having only one exposed surface. This occurs for instance in the attachment of a luggage rack to the roof of an automobile. It has heretofore been the practice within the automobile industry to use a blind fastener type of insert which can be quickly inserted into a predrilled hole within the roof panel. A blind fastener insert which has been often used in this situation is the "Jack Nut" threaded blind fastener insert having the "Raintite" positive seal. This particular blind fastener insert has a soft plastic vinyl coating which provides a positive seal against weather as well as being an effective absorbant of shock and vibration. This "Jack Nut" threaded blind fastener insert with the "Raintite" positive seal is available from the Molly Fastener Group of the Emhart Corporation having a place of business in Temple, Pennsylvania.

The installation of the aforementioned blind fastener insert has been heretofore normally accomplished by mounting the insert onto the mandrel of an installing tool. The mandrel is thereafter automatically rotated so as to threadably engage the threaded portion of the blind fastener insert. The threadably engaged blind fastener insert is next inserted into a predrilled hole. The insert is then set by actuating the installation tool so as to provide a pull-back action against the threaded mandrel engagement with the insert. This should result in a uniformly deformed blind fastener insert being set against the blind side of the roof panel. The component such as a roof rack can now be assembled to the roof of the car by using ordinary machine screws to threadably engage the set blind fastener insert.

It is to be appreciated that in a high volume production situation, little time can be spent in setting each blind fastener insert within a panel. This has resulted in the threaded mandrel not always properly engaging the threaded portion of the blind fastener insert during the step of threading the blind fastener insert onto the mandrel. This has resulted in the stripping of the threads in the threaded portion of the blind fastener insert. This has also resulted in an imperfectly set blind fastener insert when the installation tool has been actuated. The thus imperfectly set blind fastener does not present a properly oriented threadable portion for engagement with the ordinary machine screw used during the high volume assembly operation. Furthermore, when utilizing the "Jack Nut" blind fastener with the "Raintite" positive seal, the flanged portion of the blind fastener is not properly seated against the roof panel so as to provide a positive seal against adverse weather conditions.

OBJECTS OF THE INVENTION

It is an object of this invention to provide a new and improved tool for installing blind fastener inserts in high volume production situations.

It is another object of this invention to provide an installation tool with a new and improved member for engaging the threadable portion of a threadable fastener insert.

It is a still further object of this invention to provide an automatic installation tool with a new and improved member for engaging and thereafter setting a blind fastener insert.

SUMMARY OF THE INVENTION

The above and other objects are achieved according to the present invention by providing a tool which quickly installs a blind fastener insert into a thin wall or panel. The installation tool includes a pneumatic actuated mandrel which can quickly enter the head portion of the threadable blind fastener insert and thereafter accurately register with the end portion of the blind fastener insert. The mandrel has a spreadable collet located thereon which spreads over a raised end of the mandrel when the tool is pneumatically actuated. The spreading of the collet over the raised end of the mandrel is accomplished by a forward biasing of the collet with respect to the mandrel. The thus spread collet captures the end of the blind fastener insert and pulls the same toward the thin wall or panel so as to collapse the blind fastener insert. The spreadable collet returns to its initial position relative to the raised end of the mandrel when pneumatic action is terminated.

BRIEF DESCRIPTION OF THE DRAWINGS

The above and other features of the invention will now be particularly described with reference to the accompanying drawings, in which.

DESCRIPTION OF THE PREFERRED EMBODIMENT

Figures 1, 2, 3:
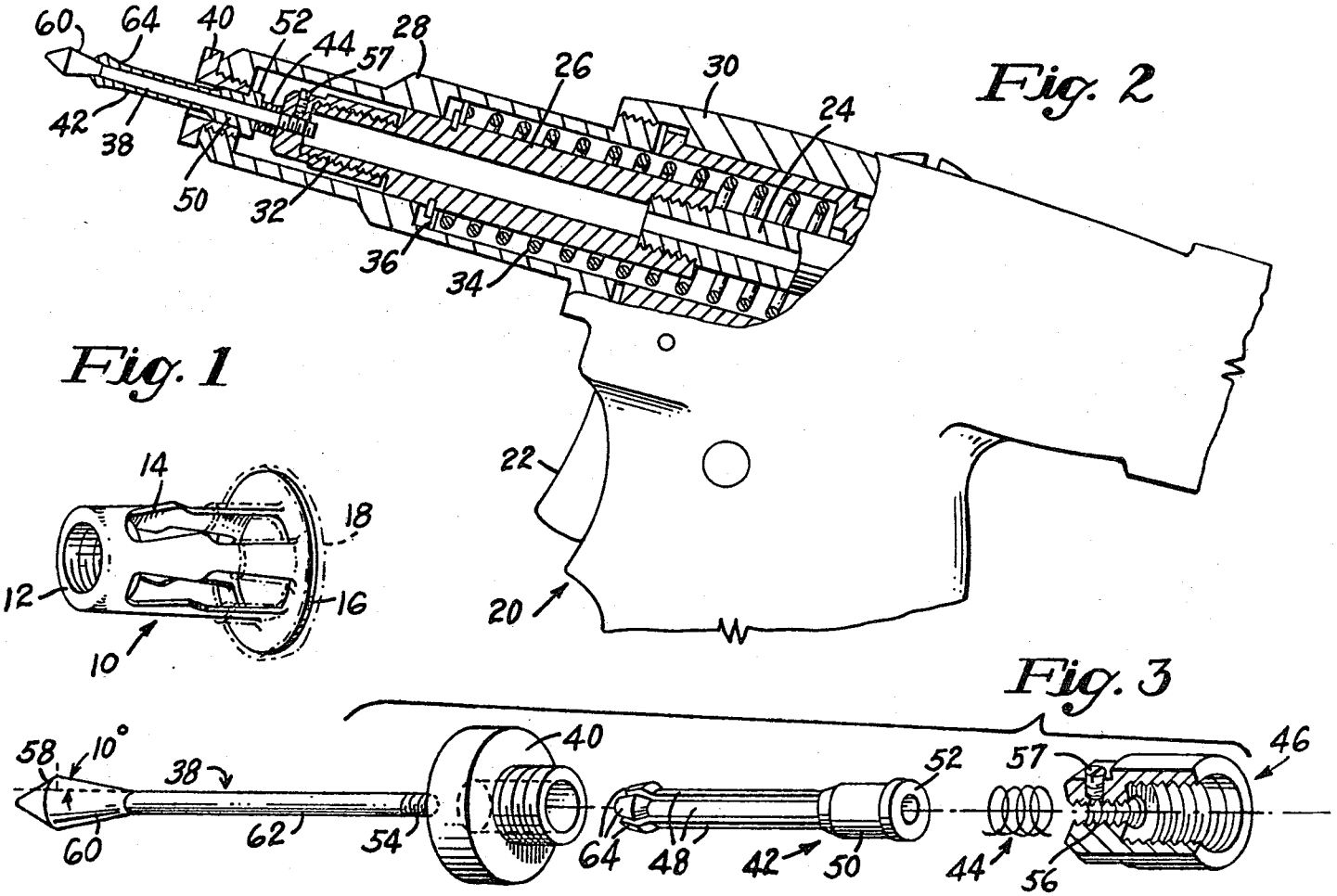
FIG. 1 illustrates a type of threadable blind fastener insert that can be automatically installed in accordance with the invention.
FIG. 2 is a view partially in cross section of the installation tool according to the present invention.
FIG. 3 is an exploded view of the tool elements which engage the blind fastener insert of FIG. 1.

Referring to FIG. 1, a threadable blind fastener insert 10 is generally illustrated. The insert 10 is seen to comprise a threadable end portion 12 having a set of four legs generally indicated by the label 14 extending therefrom. The legs 14 terminate in a top portion or head 16. The head 16 of the insert may be coated with a thin layer of soft vinyl plastic. This is denoted in dotted outline form as a coating 18 which encompasses the head 16 as well as a portion of each of the four legs 14. It is to be noted that the aforementioned threadable blind fastener is commercially identified as the "Jack Nut" threadable blind fastener insert. The coating 18 is commercially identified as a "Raintite" positive seal. The "Jack Nut" threadable blind fastener insert is offered with or without this "Raintite" positive seal by the MOLLY Fastener Group of Emhart Corporation, having a place of business at Temple, Pennsylvania.

Referring now to FIG. 2, an installation tool 20 for installing the threadable blind fastener insert 10 is illustrated in partial cross section. The installation tool 20 is preferably a modified "POP rivet" gun available from the POP Rivet Division of Emhart Corporation, having a place of business in Shelton, Connecticut. The "POP rivet" gun is particularly identified by the commercial product designation PRG-520. The installation tool 20 is seen to have a trigger 22 which when depressed actuates a pneumatic system that produces a rearward motion on a hydraulic piston rod 24. The pneumatic system is not particularly disclosed since it is part of a commercially available tool, namely, the PRG-520 "POP rivet gun". Furthermore, pneumatic systems within hand tools of this type are well known in the art.

The hydraulic piston rod 24 is connected to a hollow cylindrical member 26 which slidably engages a housing 28. The housing 28 is threadably fastened to the main body 30 of the installation tool so as to allow for easy removal when the hollow cylindrical member 26 is to be accessed. As will become apparent hereinafter, the hollow cylindrical member 26 is actually an adapter element which accommodates various elements threaded onto its end 32. The adapter element 26 is normally biased toward the nose of the tool 20 by a spring 34 engaging a snap ring 36 fastened to the adapter element 26.

It is to be appreciated that the various elements thus far discussed are present within the heretofore mentioned PRG-520 "POP rivet" gun. In accordance with the invention, a series of elements are attached to the aforementioned parts of the commercially available "POP rivet" gun. These elements are illustrated in FIG. 3 and are seen to include a mandrel 38, a nose piece 40, a collet 42, a spring 44 and a mandrel holder 46. The collet 42 preferably comprises either three or four flexible legs such as 48 which extend from a cylindrical base 50 having a flanged end 52. The legs 48 are preferably 1/32 inch (0.0794 cm) in thickness so as to be capable of repeatedly flexing relative to the cylindrical base 50. The collet 42 is moreover preferably fabricated from an RDS tool steel available from the Carpenter Steel Corporation, Reading, Pennyslvania. This tool steel provides the requisite flexing ability that is needed in the legs 48. The spring 44 is preferably a light piano wire spring having a 0.016 inch (0.0406 cm) diameter. The spring also preferably has a free length of 7/32 inch (0.556 cm).

The collet 42 normally inserts into the nose piece 40 until the flanged end 52 is seated against the rear of the nose piece. This results in the cylindrical base 50 slidably engaging the cylindrical hole in the nose piece. The mandrel 38 inserts through the thus positioned collet 42 as well as through the spring 44. A threaded end 54 of the mandrel 38 engages a threaded opening 56 in the mandrel holder 46. The degree of engagement of the threaded end 54 within the threaded opening 56 is maintained by a set screw 57.

Referring to FIG. 2, the mandrel holder 46 is seen to be threadably fastened onto the end 32 of the adapter element 26. The mandrel 38 projects outwardly from the mandrel holder 46 by an amount dependent on the degree of threaded engagement with the mandrel holder 46 as maintained by the set screw 57. The mandrel 38 furthermore extends through both the spring 44 and the collet 42 which are mounted thereon. The nose piece 40 is seen to threadably fasten onto the end of the housing 28 so as to provide a slidable mounting for the collet 42. The spring 44 is substantially compressed so as to provide a forward bias on the collet 42 causing its flanged end 52 to seat against the rear of the nose piece 40. In this regard, the free length of 5/16 inch (0.794 cm) is preferably compressed approximately 7/32 inch (0.556 cm) to a compressed length of 3/32 inch (0.0369 cm).

Referring again to FIG. 3, it is seen that the mandrel 38 has three distinct portions, namely a tip 58, a tapered portion 60 and a stem 62. The stem 62 preferably has a uniform diameter which is substantially less than the larger raised diameter of the tip 58. The tapered portion preferably has a uniform slope of 10° defining the change in diameter from the stem 62 to the larger raised diameter of the tip 58. The collet 42 is seen to have angularly shaped grips 64 at the end of each collet leg 48. Referring to FIG. 2, the angularly shaped grips 64 are normally positioned at the beginning of the tapered portion 60. The normal position of the grips 64 can be arrived at by defining the degree of threaded engagement of the mandrel 38 with respect to the mandrel holder 46. It is to be noted that the thus positioned grips 64 have a sloped contact surface 66 which complements the slope of the tapered portion 60 of the mandrel. These leading edge slopes are seen to extend back a relatively short distance from the tip end of each collet leg. The thus normally positioned grips allow a threadable blind fastener insert 10 to be mounted on the installation tool 20 as will now be described.

Figure 4:
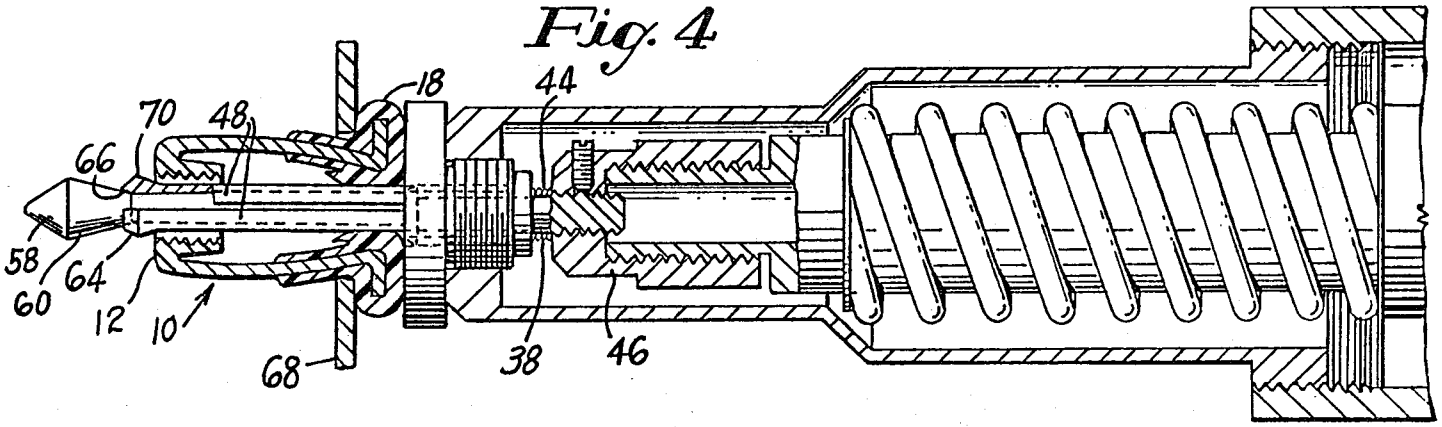
FIG. 4 illustrates the engagement of the tool element with the blind fastener insert.

Referring to FIG. 4, the threadable blind fastener insert 10 having the coating 18 has been mounted on the installation tool 20 and inserted into a panel 68. The tip 58 on the mandrel 38 has been pushed through both the coating 18 and the threadable end portion 12 before insertion of the threadable blind fastener insert 10 into the panel 68. The tip 58 is seen to project completely through the threadable end portion 12 when the nose piece 40 is pressed firmly against the coating 18. It is to be furthermore noted that the angularly shaped grips 64 associated with each of the collet legs 48 also extend completely through the threadable end portion 12.

The setting of the threadable blind fastener insert 10 by the installation tool 20 will now be described. Depression of the trigger 22 on the installation tool 20 causes the hydraulic piston rod 24 to begin a rearward stroke. The adapter element 26 hence moves rearwardly so as to compress the spring 34. As the adapter element 26 moves rearward, the mandrel 38 starts to move back into the collet 42. This relative movement of the mandrel 38 with respect to the collet 42 occurs because the collet 42 is not free to move rearwardly. Specifically, the spring 44 maintains a forward bias on the flanged end 52 of the collet 42 so as to prevent the collet from initially moving with the mandrel. The relative movement of the mandrel 38 with respect to the collet 42 allows the tapered portion 60 of the mandrel to move underneath the angularly shaped grips 64 of the collet legs 48. This relative movement is easily accomplished by virtue of the matching slopes of the contact surface 66 with respect to the mandrel's tapered portion slope. The relative movement produces a spreading of the collet legs 48 and a significantly larger gripping circumference defined by the angularly shaped grips 64. As the collet legs 48 thus become spread, the angularly shaped grips 64 capture the threaded end portion 12 of the threadable blind fastener insert 10. In this regard, the grips are each seen to have a gradual outward flaring 70 which can engage without damaging the beginning thread of the threaded portion 12. It is to be noted that the capturing of the end portion 12 occurs before the mandrel holder 46 has moved a distance sufficient to establish a free length of the spring 44. In this regard, the mandrel holder 46 preferably moves in the approximate range of 1/32 inch (0.0794 cm) to 3/32 inch (0.238 cm) during the travel of the angularly shaped grips 64 up the tapered portion 60 of the mandrel. This is substantially less than the 7/32 inch (0.556 cm) of compression in the spring 44. Any further travel of the mandrel holder 46 so as to firmly capture the threaded end 12 is substantially less than the remaining degree of compression in the spring 44.

Figure 5:
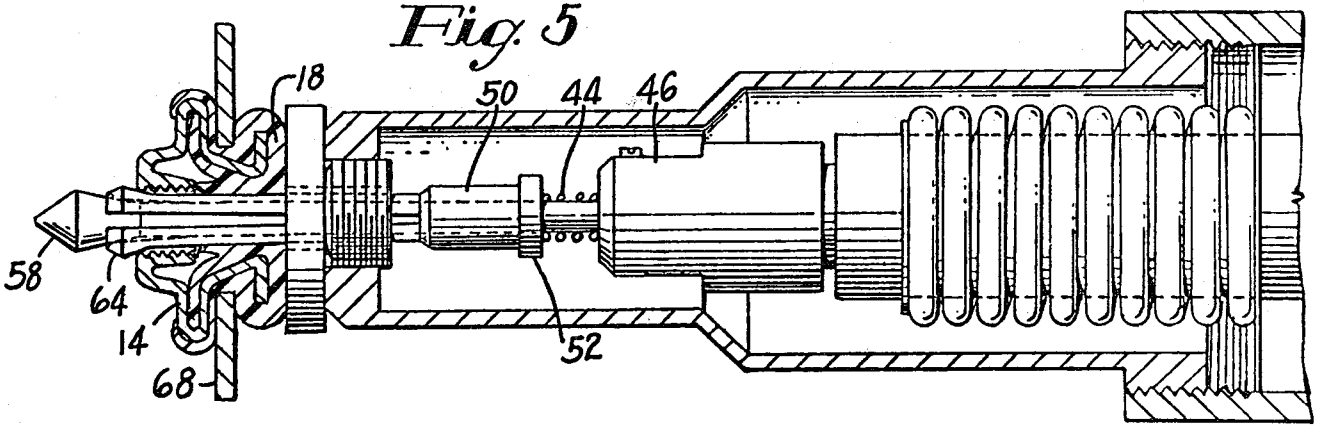
FIG. 5 illustrates the setting of the blind fastener insert by the installation tool.

The spread collet legs 48 now exert a continuous pullback force on the threaded end portion 12 of the blind fastener insert 10. This pullback force is approximately 500 pounds (2,224 Newtons) in magnitude which is achieved in the PRG-520 POP rivet gun by connecting the gun to an air pressure source of 40 to 50 psi (275.8 to 344.8 kPa) The resistance of the threadable blind fastener insert 10 to this force is soon overcome and the legs 14 begin to collapse. The rearward stroke of the mandrel 38 continues until the blind fastener 10 is in the final collapsed state illustrated in FIG. 5.

The operator of the installation tool 20 now releases the trigger 22 which in turn dissipates the pullback force on the mandrel 38. The spring 34 extends as the pullback force is dissipated which in turn causes adapter element 26 to move forward. This causes the mandrel holder 46 and the mandrel 38 to also move forward. As the mandrel holder 46 moves forward, it starts to compress the spring 44 against the flanged end 52 of the collet 42. The flanged end 52 of the collet seats up against the rear portion of the nose piece 40. The mandrel 38 continues to move relative to the now stationary collet 42. This allows the tapered portion 60 to move out from underneath the angularly shaped grips 64 of the collect 42. The thus repositioned mandrel 38 and collet 42 can now be removed from the collapsed threadable blind fastener insert 10.

Figure 6:
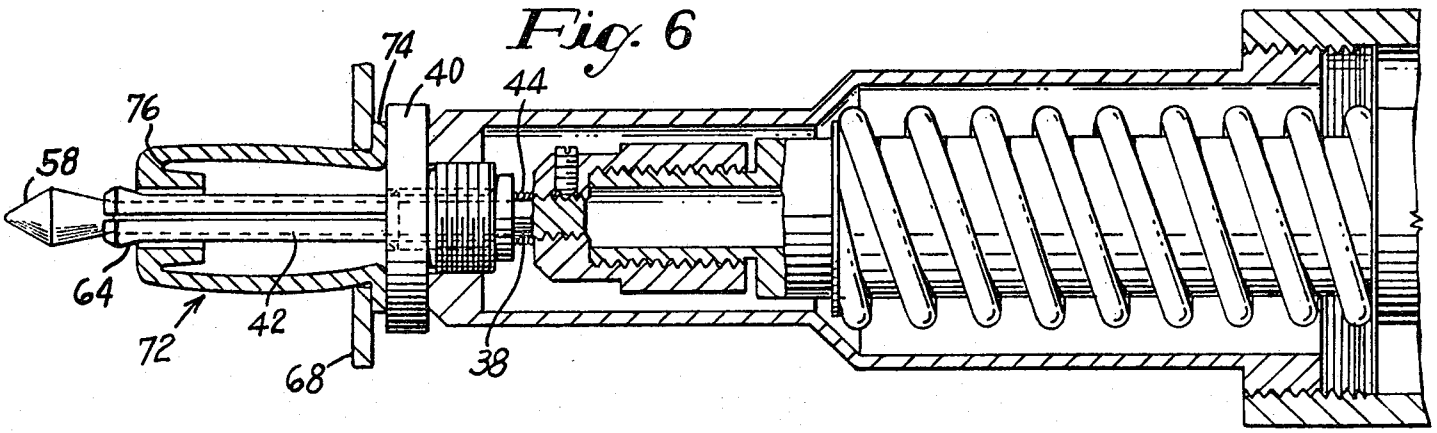
FIGS. 6 and 7 illustrates the operation of the installation tool relative to an alternative blind fastener insert.
Figure 7:
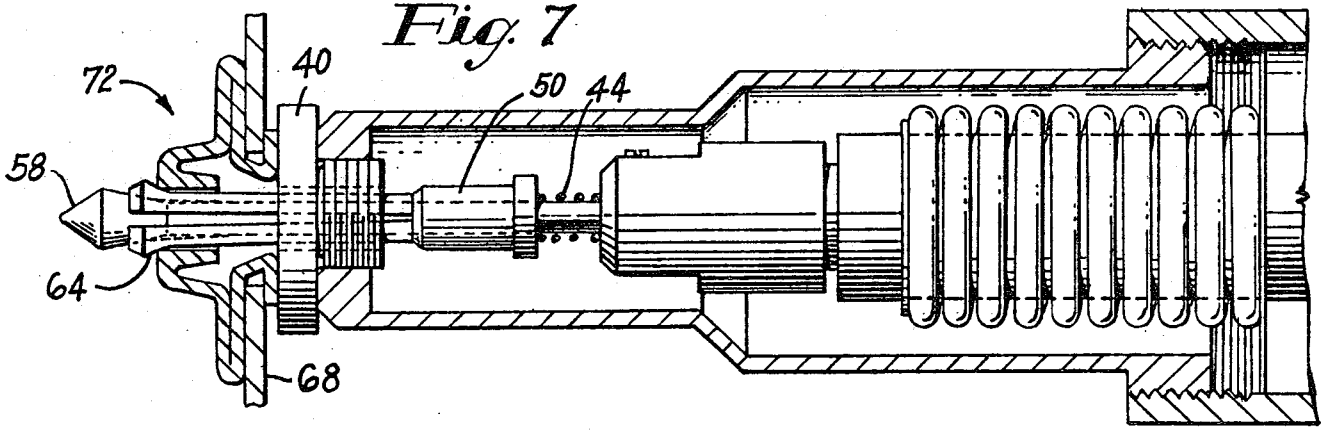

It is to be noted that the installation tool 20 will also work with other types of blind fastener inserts. This is illustrated in FIG. 6 wherein an uncoated and non-threaded blind fastener insert 72 is seen to be engaged by the mandrel 38 and collet 42. The nose piece 40 is in this instance seated against the head 74 of the blind fastener insert. It is to be noted that the extension of the mandrel tip 58 and the angularly shaped grips 64 beyond the end 76 of the insert 72 is substantially less than the compressed length of the spring 44. The blind fastener insert 72 illustrated in FIG. 6 is substantially the same length as the threadable blind fastener insert 10 so as to produce this desired extension. A different length of mandrel 38 and collet 42 would be required to match a different size insert. The appropriately matched mandrel and collet allow the end 76 to be captured by the grips 64 before the biasing force of the spring 44 has been dissipated. This produces the set blind fastener insert 70 illustrated in FIG. 7.

From the foregoing, it is to be appreciated that a preferred embodiment has been disclosed for a tool which sets threadable blind fastener inserts. It should be understood that the construction of the tool elements may vary without departing from the scope of the present invention.

What is claimed is:

1. A pneumatic tool for setting blind fastener inserts said tool comprising:

a pneumatic system within said pneumatic tool, said pneumatic system being actuated by an operator of the tool;

means, responsive to the actuation of said pneumatic system, for drawing back on a moveable element within said pneumatic tool; and means, attached to said moveable element, for engaging the threadable blind fastener inserts, said engaging means comprising, a mandrel threadably attached to said moveable element and extending through a nose of said tool, a collet mounted on said mandrel and extending through the nose of said tool and a spring mounted on said mandrel between said collet and said moveable element said spring being normally compressed when said pneumatic system has not been actuated.

2. The pneumatic tool of claim 1 wherein said spring mounted on said mandrel is compressed by an amount sufficient to allow said movable element to move an appreciable distance rearwardly without loss of compression so as to thereby maintain the collet against the nose of the tool during the initial stage of the moveable element being drawn back.

3. The pneumatic tool of claim 1 wherein said mandrel comprises a raised end, said raised end having a sloped rise wherein the diameter increases at a predefined slope.

4. The pneumatic tool of claim 3 wherein said mandrel further comprises a portion extending outwardly from said moveable element, said mandrel portion having a uniform diameter, and wherein said collet comprises;

a cylindrical base slidably mounted on said mandrel portion having a uniform diameter; and at least three flexible legs extending from said cylindrical base along the length of said mandrel portion having a uniform diameter, each of said flexible legs terminating at the beginning of the sloped rise of said raised end.

5. The pneumatic tool of claim 4 wherein the terminal ends of each of said flexible legs comprises:

an angularly shaped end having a sloped contact portion of the same slope as the sloped rise of the raised end of said mandrel.

6. The pneumatic tool of claim 1 wherein said threadable attachment of said mandrel to said moveable element comprises:

means for adjustably maintaining the degree of threadable attachment of said mandrel with respect to said moveable element so as to thereby define the length of mandrel extending from said moveable element.

7. A tool for installing a blind fastener insert into a hole, said tool comprising:

a mandrel which is moveable rearwardly during the installation of the blind fastener insert, said mandrel having a first portion of uniform diameter and a second portion of varying diameter so as to define a sloped rise at the end of said first portion;

a collet mounted on said mandrel so as to allow relative movement with respect to said mandrel, said collet having at least three flexible collet legs extending along the length of said mandrel and terminating at the second portion of said mandrel when said mandrel is in the forwardmost position; and means for biasing said collet forward against the rearward motion of said mandrel so as to cause the collet legs of said collet to spread as the second portion of said mandrel moves rearward relative to the ends of said collet legs, said forward biasing being dissipated during the rearward movement of said mandrel.

8. The tool of claim 7 wherein each flexible collet leg comprises:

an angularly shaped end at the end of each leg, said angularly shaped end having a sloped contact portion of substantially the same slope as the sloped rise of said second mandrel portion.

9. The tool of claim 7 further comprising:

means, located within a housing of said tool, for drawing said mandrel rearwardly, said mandrel being adjustably attached to said drawing means so as to define the length of mandrel extending therefrom.

10. The tool of claim 9 wherein said biasing means is a spring mounted on said mandrel in front of said means for drawing said mandrel rearwardly so as to bias said collet against the housing of said tool during the initial rearward movement of said mandrel.

* * * * *